US005558765A

United States Patent [19]

Twardzik

[11] Patent Number: 5,558,765

[45] Date of Patent: Sep. 24, 1996

[54] APPARATUS FOR SUBJECTING HYDROCARBON-BASED FUELS TO INTENSIFIED MAGNETIC FIELDS FOR INCREASING FUEL BURNING EFFICIENCY

[76] Inventor: Robert J. Twardzik, 1002 Newgate Dr., Allentown, Pa. 18103

[21] Appl. No.: 411,530

[22] Filed: Mar. 28, 1995

[51] Int. Cl.[6] ..... F02M 27/04

[52] U.S. Cl. ..... 210/222; 123/538

[58] Field of Search ..... 210/222; 123/538, 123/536

[56] References Cited

FOREIGN PATENT DOCUMENTS 189989 10/1984 Japan ..... 210/222
433035 6/1991 WIPO ..... 210/222

*Primary Examiner*—Matthew O. Savage

*Attorney, Agent, or Firm*—Sanford J. Piltch

[57] ABSTRACT

Apparatus for the intensified exposure of a hydrocarbon based fuel to a magnetic field comprising at least two permanent magnets having opposite faces polarized north and south, a cover box for containing each of said magnets made from non-magnetic material for containing said magnets and having a bottom opening and a peripheral depending flange having curved hollows for fitting closely about a fluid containment vessel, a backing plate for closing said bottom opening made from non-magnetic material and being recessed inward to permit the close fit of the fluid containment vessel within said curved hollows, and strapping means for securing said cover boxes in fixed diametrically opposed position about said fluid containment vessel for creating an electromagnetic circuit having an enhanced, substantially uniform, mono-directional, magnetic flux density for the polarization of the molecules of said fuel to increase the combustion efficiency of said fuel.

6 Claims, 3 Drawing Sheets

APPARATUS FOR SUBJECTING HYDROCARBON-BASED FUELS TO INTENSIFIED MAGNETIC FIELDS FOR INCREASING FUEL BURNING EFFICIENCY

BACKGROUND OF THE INVENTION

The invention resides in the field of treatment of hydrocarbon fuels in liquid or gaseous form to increase the fuel burning efficiency by subjecting said fuel flowing in containment vessels or conduits to a shaped uniform magnetic field having a consistent directional flux.

The concept of exposing hydrocarbon molecules to magnetic fields dates to J. D. van der Waals and his experiments in the field. Hydrocarbon fuels have long branched geometric chains of carbon atoms which have a tendency to fold over onto themselves and on adjoining molecules due to intermolecular electromagnetic attraction existing between like molecules or atoms, which is known as van der Waals forces. In his experiments, van der Waals applied focused magnetic fields to hydrocarbon chains (oil) and found that the viscosity of the fluid decreased with the application of the field which, in turn, caused an increase in the flow rate in the fluid.

The experiment is noteworthy in that hydrocarbon fuels do not exhibit a dipole moment. It is to be understood that the hydrocarbon based fuel should not have responded as it did to the presence of the magnetic field. However, Faraday's investigations showed that all substances are magnetic, although in most cases the magnetic effect is very small. In the case of hydrocarbon based fuel, which was formerly thought to be a polar substance without a magnetic moment, the van der Waals experiment proved that electrons in all substances can be affected by an external magnetic field.

It is very important to understand that in a fluid which is subjected to an external magnetic field the electron excitation (magnetic moment) occurring affects molecular orientation. Due to the fact that we are dealing with a fluid, a rearrangement of electron, atomic and molecular symmetry occurs to accommodate the applied external magnetic field. This accommodation is attributed to the fact that on the molecular level a spinning electron subjected to a precise amount of electromagnetic energy will absorb that energy and "spinflip" into an aligned state. The exact amount of electromagnetic energy required to produce a "spinflip" is determined by the g-factor, the gyromagnetic ratio, discovered by Paul Dirac. Dirac noticed that whole atoms absorbed and released energy as the electrons underwent "spinflip".

The "spinflip" phenomenon is merely another way of describing the principle of Conservation of Energy. In the case at hand, this means that momentum can not simply appear and disappear, as momentum, i.e. angular momentum, is always conserved in any physical process.

When a magnetic force is applied, the moment as seen by the electron excitation causes the molecule to tend to align with the direction of the magnetic field. As the axis of the electrons become aligned with the external magnetic field, the angular momentum of the molecule no longer averages out to zero as in the normal case in molecules not possessing permanent dipole moments. The fluctuating dipole moments under the influence of the external magnetic field acquires a net attractive force which produces a stronger bonding with an oxygen ion.

As a result of the produced moment, the complex fuel molecules tend to uncluster, straighten and produce higher combustion efficiencies. The increase in combustion efficiency is attributable to the unfolding of the hydrocarbon molecules which produce an increased surface area for more complete oxidation of the fuel. The unfolding of the fuel molecules is the major effect of the dipole being removed from its neutral state by the applied magnetic field.

There is also a minor effect which contributes to the combustion efficiency, i.e. the unclustering of the molecular groupings. Hydrocarbon molecules have a tendency to interlock with other elements (impurities), not forming other compounds, but temporarily forming pseudo-compounds. Subjecting these pseudo-compounds to magnetic fields of appropriate strength and direction tends to uncluster the molecular grouping resulting in a reduction of fluid viscosity at the macroscopic level.

Increased combustion yields increased fuel efficiency with lower hydrocarbon emissions from hydrocarbon based fuel burning apparatus. However, certain problems remain to be overcome, such as whether to focus the magnetic field in opposition or directional alignment, determine magnetic field strength, select appropriate magnetic materials and determine mounting arrangements for the greatest efficiency. Earlier attempts have proven to be less than satisfactory, producing only limited results as can be seen from the discussion of the teachings of the several patents which follow.

One earlier device, as described in U.S. Pat. 4,956,084 [Stevens], attempts to prevent formation of scale on the inner wall of a conduit transporting hydrocarbon based liquid fuel with like poles positioned at diametrically opposite locations about the conduit. According to the Stevens patent, a particular arrangement of permanent magnets mounted into plastic boxes and arranged diametrically opposite each other with common poles of the magnet placed against the conduit about which the magnets and boxes are strap mounted is described. The effect is to prevent scaling from occurring on the inner walls of the conduit from the liquid flowing therethrough by forcing the molecules which would attach themselves to the inner walls of the conduit toward the center of the conduit.

There is no mention in the Stevens patent that the liquid is or may be a hydrocarbon based fuel (petroleum distillate) or that the particular arrangement of the magnets about the liquid containing conduit will assist in the burn efficiency of any liquid passing between the magnets. Nor is there any disclosure or teaching of a particular positioning along the length of the conduit in order to effectuate the intended result.

Other patents which are also deemed to be material to the present invention are discussed below. U.S. No. Pat. 5,059,743 [Sakuma] describes a treatment of hydrocarbon fuel using a magnet having a very weak magnetic flux density as well as a non-uniform flux density at each pole. The device disclosed in the Sakuma patent is described to be useful in the pre-treatment of fuel still contained within a storage system substantially prior to the time the fuel is being used. A disadvantage of any magnetic treatment of hydrocarbon based liquid fuels is that the magnetic treatment deteriorates with time. For this reason, coupled with the appreciably weaker magnetic flux density than that existing in the present invention, the device of the Sakuma patent is believed to be substantially disadvantageous in increasing the fuel burn efficiency.

Another patent, U.S. Pat. 4,357,237 [Sanderson], employs a cylindrical dual domain magnet having parallel, longitudinal magnetic fields for treating a number of fluids including water and liquid or gaseous fuels. The treatment process consists of the fuel flowing through a number of annular treatment chambers which subjects the liquid to a magnetic field substantially parallel to the direction of liquid flow. The present invention subjects the fluid flow to a magnetic field which is normal (or perpendicular) to the flow and is applied in a uniform direction. The device of the Sanderson patent subjects the fluid being treated to alternating magnetic fields which will create magnetic eddies and fail to affect the fuel molecules to extend or allow them to unfold so as to expose the maximum surface area of the molecules in order to achieve the maximum fuel burning efficiency.

Another patent describing the magnetic treatment of hydrocarbon fuels and other fluids is U.S. Pat. 4,716,024 [Pera] which discloses a device that employs flat, circular magnets having a central aperture. The magnets are suspended in a porous outer support and covering and are spaced apart so that the magnets are prevented from collapsing onto each other so as to provide multiple paths for the fluid to be treated to flow around, over and through the plurality of magnets in the device. The Pera patent is disclosing a system where magnetic fields extend primarily longitudinally through the device and substantially parallel to the fluid flow, although a field may be created for a short distance and duration which is normal to the fluid flow. However, the net magnetic effect is substantially parallel to the fluid flow. This is unlike the present invention which produces a magnetic field of constant magnitude and direction normal to the flow of the fluid to be treated. The staggered pattern of magnetic poles of the Pera device alternately change the earlier created dipole moment which has the disadvantageous effect of neutralizing the earlier produced polarizing effects on the molecules of the fluid. Taken as an entire system, the Pera apparatus provides only a polarizing or neutralizing effect of the last magnetic force applied to the fluid just prior to exiting the apparatus. This is not consistent with the constant reinforcing effect of the uniform constant magnetic field applied to the fluid fuel of the present invention.

Another device for magnetically treating hydrocarbon fuels is disclosed in U.S. No. Pat. 4,933,151 [Song] which utilizes flat, circular magnets also with a central aperture. The difference between the Song apparatus and the Pera apparatus is that the Song apparatus permits fluid to flow only through the central aperture of the magnets. This would have a beneficial effect except that the magnetic properties of the magnets are arranged such that like poles are placed immediately adjacent each other which essentially reduces the effectiveness of the apparatus as a bipolar device. When utilizing magnets with like poles facing each other, instead of subjecting the fluid to a uniform mono-directional field, the opposing fields cause a reversal of the dipole moment which is created in one magnet and then offset by the next successive magnet. Further, the Song apparatus uses magnetic fields of fairly low flux densities with the present invention utilizing flux densities approximately ten times greater to produce a more intense mono-directional additive magnetic field having a greater effect and being able to more readily polarize the long chain carbon molecules of the liquid fuel to cause them to unfold exposing a greater surface area and increasing the fuel burning efficiency thereby.

It is, therefore, an object of the present invention to increase the fuel burning efficiency of a hydrocarbon fuel passed through a conduit or containment vessel about which the apparatus is mounted in diametrically opposed positions to create a uniform magnetic flux density to affect the molecules of the fluid fuel in such a manner as to increase the fuel burning efficiency.

It is a further object of the present invention to create a uniform magnetic field normal to the fuel flow direction in order to create a more laminar flow of the fuel within the containment vessel or conduit and to affect the molecules of the fuel to achieve the more laminar flow by causing them to unfold when subjected to the uniform intensified magnetic field.

It is still a further object of the present invention to position the apparatus for intensified magnetic treatment of the liquid fuel in close proximity to a fuel injecting apparatus or carburetion system such that the effect of the magnetic field on the molecules of the liquid fuel will be maintained as the fuel flows into the fuel injection apparatus or carburetion system for either an internal combustion or diesel engine powered by a hydrocarbon based liquid or gaseous fuel.

Other objects will appear hereinafter.

SUMMARY OF THE INVENTION

The apparatus of the present invention can best be described as a means for the intensified exposure of a hydrocarbon based fuel to a magnetic field. The apparatus is comprised of at least two permanent magnets, each a parallelepiped having a greater length than width, and a first and a second face. The magnets are polarized such that the first face is the north pole of each of the magnets and the second face is the south pole of each of the magnets. A cover box, for containing each of the at least one of the magnets, made from non-magnetic material, is sized and shaped to completely contain the at least one of the magnets within the cover box. The cover box also has a bottom opening and a peripheral depending flange. The flange has opposite side curved hollows for fitting closely about a fluid containment vessel. A backing plate for closing the bottom opening in the cover box is also made from non-magnetic material and is recessed inward into the cover box to permit the close fit of the fluid containment vessel within the curved hollows of the depending flange.

Strapping means for securing the cover boxes in fixed diametrically opposed position about the fluid containment vessel are inserted through apertures in the cover box. The positioning of the magnets is such that each is separated from the outer surface of the fluid containment vessel only by the thickness of the backing plate. In this manner the magnets are positioned at opposing tangential points of the fluid containment vessel with the second face of one of the magnets facing the fluid containment vessel and the first face of the other of the magnets facing the fluid containment vessel to create an electromagnetic circuit having an enhanced, substantially uniform, mono-directional, magnetic flux density for the polarization of the molecules of said fuel to increase the combustion efficiency of said fuel. This creates the polarization of the long chain carbon molecules in the fuel so that the molecules unfold to expose a significantly greater surface area susceptible to combustion.

The apparatus may be further described by defining the fluid containment vessel as a conduit having a substantially circular cross-section and being positioned in proximity to an oxygen/fuel mixing apparatus. Whereby, when the apparatus is utilized in a fuel burning environment for the powering of a vehicle, or otherwise, the increase in combustion efficiency reduces environmentally harmful emissions.

BRIEF DESCRIPTION OF THE DRAWINGS

For the purpose of illustrating the invention, there are shown in the drawings embodiments which are presently preferred; however, it should be understood, that the invention is not limited to the precise arrangements and instrumentalities shown.

DETAILED DESCRIPTION OF THE PREFERRED EMBODIMENTS

The following detailed description is the best presently contemplated mode of carrying out the present invention. This description is not intended in any limiting sense, but rather is made solely for the purpose of illustrating the general principles of the invention.

Figure 1:
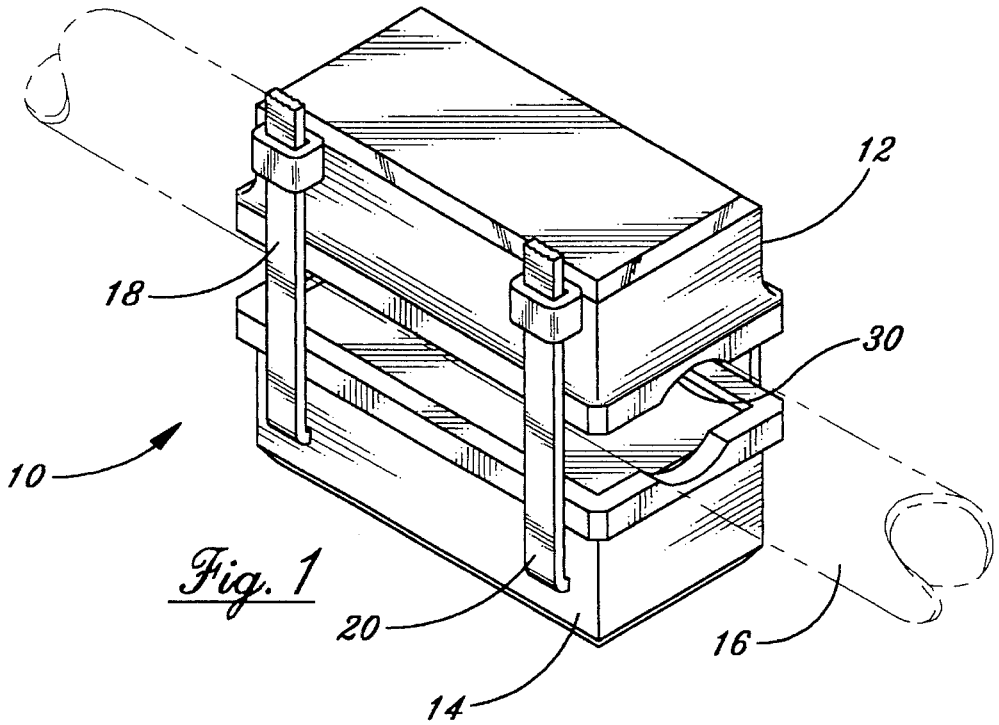
FIG. 1 is a perspective view of a preferred embodiment of the invention mounted about a liquid fuel conduit with a first magnet of the apparatus mounted diametrically opposed to a second magnet.

Referring now to the drawings in detail, wherein like numerals indicate like elements, there is shown in FIG. 1 the apparatus 10 which subjects hydrocarbon-based fuels to directional magnetic fields. Each of two segments of the apparatus 10, substantially rectangular boxes 12 and 14 are mounted in diametrically opposed position about a fluid containment vessel or conduit 16 (shown in phantom) through which a hydrocarbon-based fuel is permitted to flow. The upper and lower boxes 12, 14 (respectively are held in the particular position utilizing strapping members 18, 20 which pass through the upper portions of both upper and lower boxes 12, 14 to hold each of the boxes in the required fixed position about the conduit 16. The strapping members 18, 20 may be of a plastic material and be self-latching.

Figure 2:
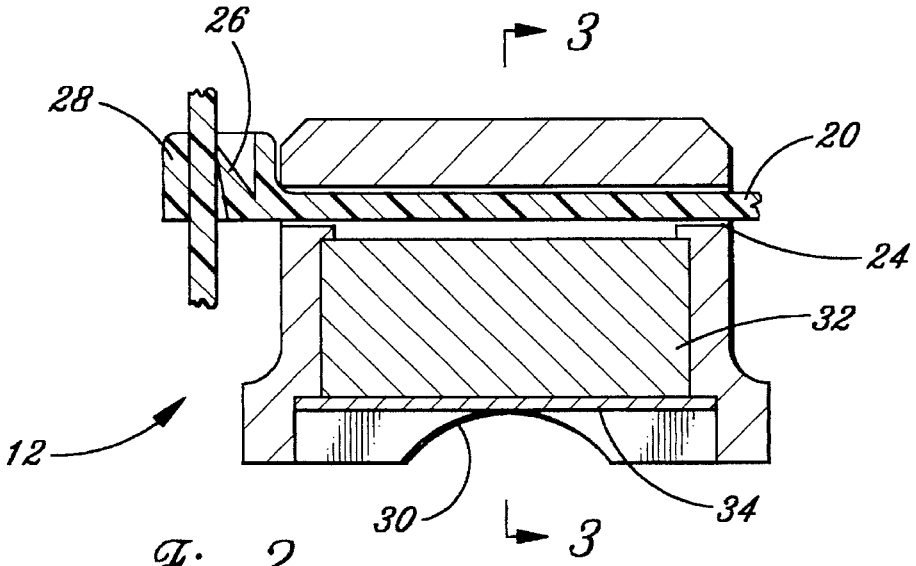
FIG. 2 is a sectional view of one half of the apparatus of the present invention taken along Line 2—2 of FIG. 3.
Figure 3:
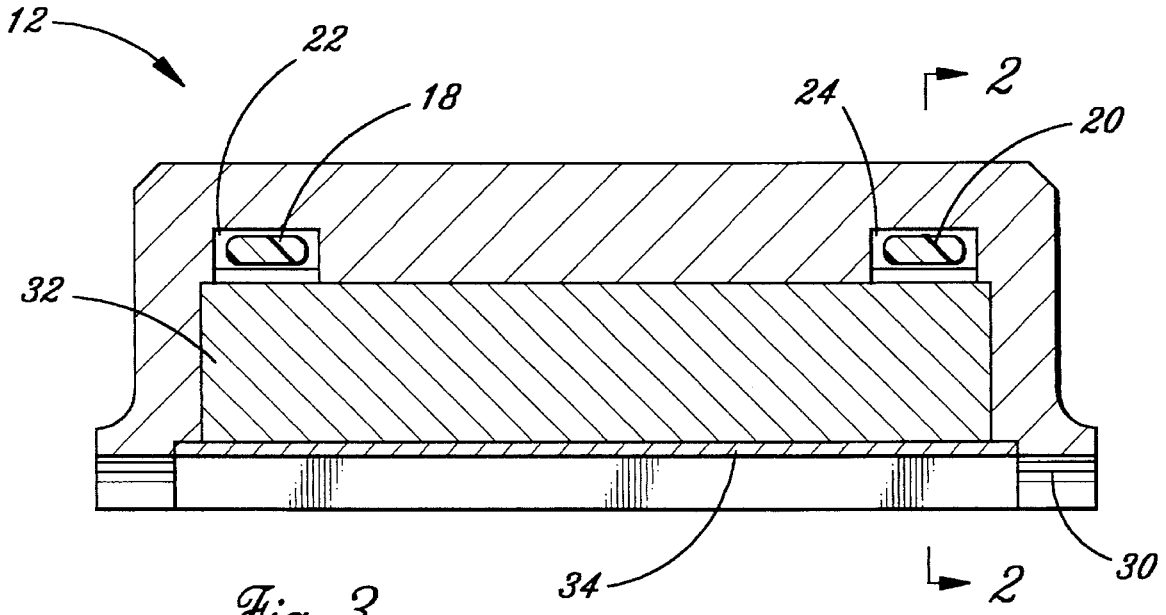
FIG. 3 is a sectional view of one half of the apparatus of the present invention taken along Line 3—3 of FIG. 2.

With reference to FIG. 3, the passages 22, 24 at respective longitudinal ends of, for example, upper box 12, permit the respective passage of each strapping member 18, 20. FIG. 2 shows how strapping member 20 passes through passage 24 and then self-latches by means of a pawl 26 contained within the self-latching portion 28, which pawl 26 cooperates with grooves (not shown) on the underside of the strapping member 20 such that when tightened about an object, the strapping member 20 becomes taut. In this manner, the strapping member 20, in cooperation with the strapping member 18, holds each of the upper and lower boxes 12, 14 in fixed position about the conduit 16.

Assisting in the positioning of the upper and lower boxes 12, 14, is a rounded hollow 30 which is cut into the lower edge of the upper box 12 at each of its longitudinal ends so that the upper box 12 can be positioned directly against a curved surface such as exhibited by conduit 16. In this manner, the permanent magnet means 32 contained within the upper box 12 is placed in almost direct contact with the conduit 16. The only separation between the permanent magnet means 32 and the outside of the conduit 16 is a very thin plate member 34 made of a non-magnetic material which has minimal affect on the electromagnetic flux density of the permanent magnet means 32 which holds the permanent magnet means 32 in position within the upper box 12. The plate member 34 may be held in place by any presently known or later discovered manner such that the permanent magnet means 32 is kept in close proximity to the conduit or containment vessel 16 as shown in FIGS. 1 and 4.

The permanent magnet means 32 may be formed of a ceramic magnetic material which is known in the art as ceramic-8. The permanent magnetic member 32 may also be made from neodymium-iron-boron, which is also known magnetic material in the field. The permanent magnetic means 32 preferably is configured as a rectangular solid measuring 1.875" in length, 0.875" in width and 0.375" in height with a margin for error of plus or minus 0.1" average for any direction. Further, in order for the permanent magnet means 32 to more easily fit within the respective upper or lower box 12, 14 it should exhibit rounded corners where the curvature of the corner approximates 3/32" radius.

Figure 4:
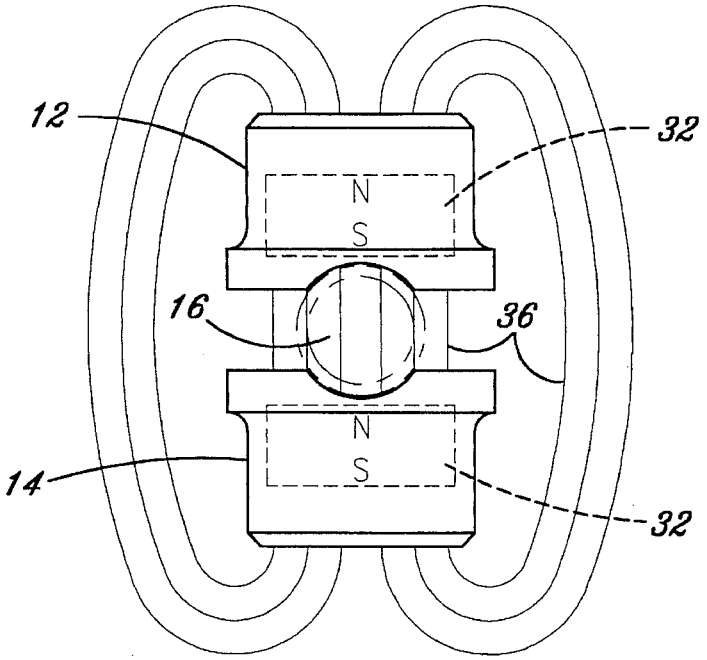
FIG. 4 is a diagrammatic view of the preferred embodiment of the present invention showing the magnetic field lines to depict the uniform mono-directional intensified magnetic flux to which the liquid or gaseous fuel within the containment vessel or conduit is subjected.

The permanent magnet means 32 is placed in each of the upper and lower boxes 12, 14 such that when the boxes 12, 14 are placed about a fluid containment vessel or conduit 16, the magnets are oriented with the North and South poles of each magnet arranged as shown in FIG. 4. The magnetic flux lines 36 are intensified or magnified through the polar cooperation of the two permanent magnet means 32 housed within the upper and lower boxes 12, 14. The cooperating magnetic flux density forms a complete electromagnetic circuit when the permanent magnet means 32 are oriented in the manner shown about the conduit 16. Thus, a completely symmetrical, magnified or intensified, electromagnetic field is formed by placing each of the upper and lower boxes 12, 14 containing permanent magnet means 32 at diametrically opposed positions about the conduit 16.

Each of the respective materials from which the permanent magnetic means 32 is made exhibits enhanced magnetic and electromagnetic properties which are significantly greater than standard magnets currently available. The neodymium, being a rare earth element, exhibits the magnetic traits, characteristics and properties listed in Table 1 set forth below.

TABLE 1

| Characteristic/Property | Symbol | Minimum | Nominal |
|---|---|---|---|
| Flux Density | $B_r$ | 10.8 | 11.2 KGs |
| Coercive Force | $H_c$ | 10.2 | 10.6 KOe |
| Intrinsic Coercive Force | $H_{ci}$ | 15.0 | 17.0 KOe |
| Max Energy Product | $BH_{max}$ | 28.0 | 30.0 MGOe |

For the other material which is preferred for the permanent magnetic means 32, the ceramic material commonly called ceramic-8, the magnetic traits, characteristics and properties of this material are listed in Table 2 set forth below.

TABLE 2

| Characteristic/Property | Symbol | Minimum | Nominal |
|---|---|---|---|
| Flux Density | $B_r$ | 3.85 | 3.95 KGs |
| Coercive Force | $H_c$ | 2.95 | 3.10 KOe |
| Intrinsic Coercive Force | $H_{ci}$ | 3.05 | 3.15 KOe |
| Max Energy Product | $BH_{max}$ | 3.40 | 3.60 MGOe |

Thus, the preferred materials, ceramic-8 and neodymium/iron/boron have significantly enhanced characteristics beyond those usually exhibited by other magnetic materials, with the neodymium material quite significantly surpassing that of the ceramic material for the properties noted in Tables 1 and 2.

Ceramic magnets and rare earth magnets are a fairly recent development in the field of engineered magnetic materials. The rare earth magnets are denominated as such for the reason that they are alloys of the rare earth group of elements which includes neodymium.

In operation, the orientation and placement of the paired permanent magnet means 32 in the orientation shown in FIG. 4, i.e. opposite poles are positioned on opposing sides of the conduit 16, the electromagnetic flux lines 36 pass through the conduit 16 and affect the hydrocarbon fluid passing through in the following manner. The hydrocarbon fluid passing through the conduit 16 is subjected to a uniform mono-directional electromagnetic field of a fairly high flux density which has the affect of polarizing the long chain carbon molecules of the fuel. This polarization causes the long chain carbon molecules to unfold to expose a significantly greater surface area which will be susceptible to combustion, and thereby increasing substantially the combustion efficiency of the fuel. As the combustion efficiency of the fuel increases unburned fuel, fuel additives, and converted compounds, i.e. emissions, are significantly reduced.

Figure 5:
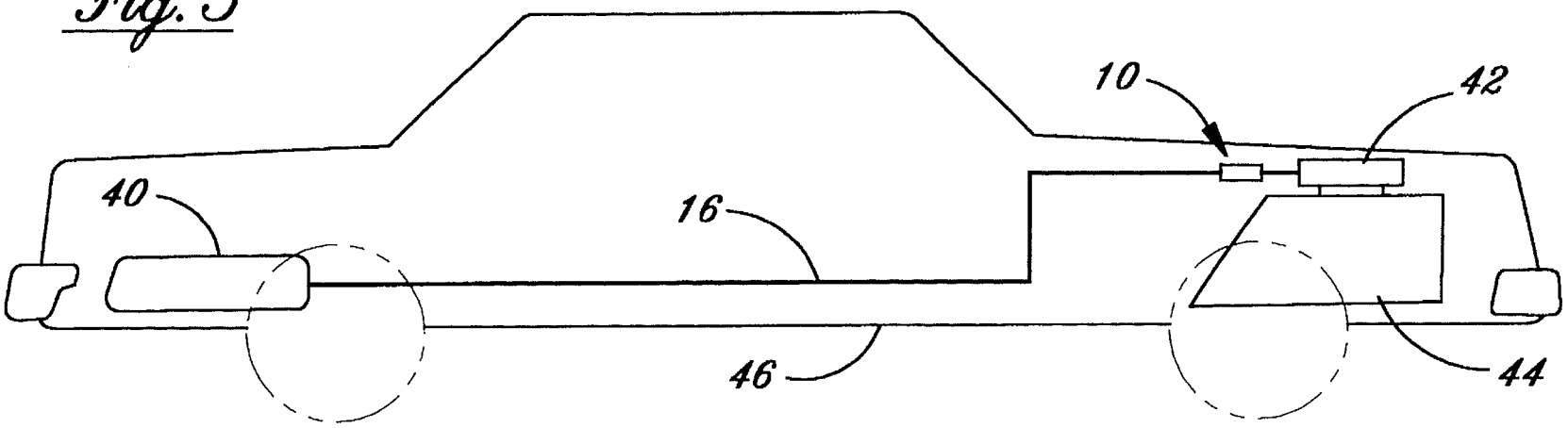
FIG. 5 is a schematic view of the present invention positioned in proximity to an oxygen fuel mixing apparatus of an engine in a vehicle.

As shown in FIG. 5, the apparatus 10 is positioned about the fuel delivery conduit 16, which is between a fuel reservoir 40 and an oxygen/fuel mixing apparatus 42. The apparatus 10 is located in proximity to an oxygen/fuel mixing apparatus 42 of a hydrocarbon based fuel burning engine 44 for the powering of a vehicle 46. The effect of the apparatus 10 positioned closely to the oxygen/fuel mixing apparatus 42 and about the fuel delivery conduit 16 is to increase the combustion efficiency and to reduce the environmentally harmful emissions of the engine in according with the test results cited herein.

As evidence of such reduction in the emissions and the increased burn efficiency of hydrocarbon based fuels using the present invention in close proximity to either a fuel injection system or a carburetion system for internal combustion gasoline powered engines certain Environmental Protection Agency Testing was performed. The present invention, as described with specific regard to the positioning of the permanent magnet means 32 about the conduit 16 and placed on the fuel delivery line proximal to the fuel injection or carburetion system, the results set forth in Tables 3 and 4 were compiled. The testing performed was in conformance to the standards and testing criteria set forth in regard to Urban Fuel Economy Tests at 40 C.F.R. 600.113–88. Tests were performed on a sample vehicle, a 1986 Mercury Zephyr. The Highway Fuel Emissions Test was performed without the present invention in position on the fuel delivery line and then with the present invention in the designated position. The test procedures were accomplished by measuring the fuel emissions using a single collection bag maintaining a constant volume sample [CVS] with a positive displacement pump.

Table 3 shows the results of emissions and calculated fuel economy on the test vehicle without using the present invention. Table 4 shows the same test being performed on the same vehicle utilizing the present invention with results showing significant reductions in the quantities of the emissions: i.e. hydrocarbons, carbon monoxide, nitrogen oxides and carbon dioxide, as well as a significant increase in fuel economy indicating a clearly notable fuel combustion efficiency increase with the use of the present invention.

TABLE 3

HFET CVS TEST WITH POSITIVE DISPLACEMENT PUMP

| | AMBIENT BAG | | | SAMPLE BAG | | MASS DATA |
|---|---|---|---|---|---|---|
| | RANGE | % F.S. | CONC. | % F.S. | CONC. | GRAMS |
| HC PPM Bag #1 | 2 | 3.5 | 5.461 | 52.1 | 77.714 | 4.485 |
| CO PPM Bag #1 | 3 | 0.5 | 6.479 | 24.3 | 287.375 | 34.951 |
| NOX PPM Bag #1 | 2 | 1.2 | 1.257 | 183.4 | 180.890 | 34.055 |
| $CO_2$ % Bag #1 | 2 | 1.4 | 0.039 | 49.4 | 1.801 | 3445.476 |

WEIGHTED MASS EMISSIONS SUMMARY

| HC - GM/MI | CO - GM/MI | NOX - GM/MI | $CO_2$ - GM/MI |
|---|---|---|---|
| 0.430 | 3.354 | 3.172 | 330.628 |

HFET FUEL ECONOMY PER 40 CFR 600.113-88
26.447 MILES PER GALLON

TABLE 4

HFET CVS TEST WITH POSITIVE DISPLACEMENT PUMP

| | AMBIENT BAG | | | SAMPLE BAG | | MASS DATA |
|---|---|---|---|---|---|---|
| | RANGE | % F.S. | CONC. | % F.S. | CONC. | GRAMS |
| HC PPM Bag #1 | 2 | 7.2 | 10.958 | 42.6 | 65.258 | 3.416 |
| CO PPM Bag #1 | 3 | 0.7 | 11.213 | 7.5 | 102.285 | 11.458 |
| NOX PPM Bag #1 | 2 | 1.9 | 2.093 | 150.9 | 149.425 | 28.248 |
| $CO_2$ % Bag #1 | 2 | 1.5 | 0.044 | 45.3 | 1.640 | 3119.233 |

WEIGHTED MASS EMISSIONS SUMMARY

| HC - GM/MI | CO - GM/MI | NOX - GM/MI | $CO_2$ - GM/MI |
|---|---|---|---|
| 0.328 | 1.100 | 2.711 | 299.322 |

HFET FUEL ECONOMY PER 40 CFR 600.113-88
29.526 MILES PER GALLON

The abbreviations used in Tables 3 and 4 can be described as follows. HC stands for Hydrocarbons; CO stands for Carbon Monoxide; NOX stands for Nitrogen Oxides; and $CO_2$ stands Carbon Dioxide. Each of these compounds have emissions measured in concentration ranges [CONC] measured in parts per million [PPM]. The measured concentration for HC has a range with a group of numeric indicators: 0 for the absence of the measured compound; 1 for 100 PPM; 2 for 300 PPM; 3 for 1000 PPM; and 4 for 3000 PPM. The measured concentration for CO has a range with a group of numeric indicators: 0 for the absence of the measured compound; 1 for 100 PPM; 2 for 250 PPM; 3 for 1000 PPM; 3 for 1000 PPM; and 4 for 2500 PPM. The measured concentration for NOX has a range with a group of numeric indicators: 0 for the absence of the measured compound; 1 for 25 PPM; 2 for 100 PPM; 3 for 250 PPM; and 4 for 1000 PPM. The measured concentration for $CO_2$ has a range with a group of numeric indicators: 0 for the absence of the measured compound; 1 for 2.5%; and 2 for 5.0%. In the weighted mass emissions summary GM/MI stands for grams per mile of the emitted compound.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. Apparatus for the intensified exposure of a hydrocarbon based fuel to a magnetic field comprising:

at least two permanent magnets each a parallelepiped having a greater length than width and first and second opposed major faces, said magnets being polarized such that the first major face is the north pole of each of said magnets and the second major face is the south pole of each of said magnets;

a pair of cover boxes made from non-magnetic material being sized and shaped to completely contain a respective one of said magnets, each said cover box having an opening and a peripheral outwardly depending flange surrounding said opening, said flange having curved hollows at opposite ends of the respective cover box for fitting closely about a fluid containment vessel;

a backing plate for closing said opening in each said cover box, each said backing plate being made from non-magnetic material, each said backing plate being recessed inward into the opening of each respective said cover box to permit the close fit of the fluid containment vessel within said curved hollows;

the first major face of all of said magnets positioned within a first of said pair of cover boxes abuts said backing plate for said first cover box, and the second major face of all of said magnets positioned within a second of said pair of cover boxes abuts said backing plate for said second cover box;

strapping means for securing said cover boxes in fixed diametrically opposed position about said fluid containment vessel with said magnets being separated from the outer surface of said fluid containment vessel only by said backing plate;

whereby said magnets are positioned proximate opposing tangential points of said fluid containment vessel with the second face of one of said magnets facing the fluid containment vessel and the first face of the other of said magnets facing the fluid containment vessel to create an electromagnetic circuit having an enhanced, substantially uniform, mono-directional, magnetic flux density for the polarization of the molecules of said fuel to increase the combustion efficiency of said fuel.

2. The apparatus of claim 1, whereby said fluid containment vessel is a conduit having a substantially circular cross-section.

3. The apparatus of claim 1, wherein said strapping means for securing the cover boxes in position about the fluid containment vessel are inserted through apertures in each of the cover boxes.

4. The apparatus of claim 1, whereby the magnetic field effects the polarization of long chain carbon molecules in said fuel so as to unfold said molecules to expose a significantly greater surface area susceptible to combustion.

5. The apparatus of claim 1, whereby said apparatus is adapted to be positioned in proximity to an oxygen/fuel mixing apparatus.

6. The apparatus of claim 1, whereby said apparatus is adapted for utilization in a hydrocarbon based fuel burning engine for the powering of a vehicle and increases the combustion efficiency and reduces environmentally harmful emissions of said engine.

* * * * *